US008619006B2

(12) United States Patent
Kim et al.

(10) Patent No.: US 8,619,006 B2
(45) Date of Patent: Dec. 31, 2013

(54) DISPLAY DEVICE AND DRIVING METHOD THEREOF

(75) Inventors: Ji-Hoon Kim, Seoul (KR); Min-Koo Han, Seoul (KR); Jae-Hoon Lee, Seoul (KR)

(73) Assignees: Samsung Display Co., Ltd. (KR); Seoul National University Industry Foundation (KR)

( * ) Notice: Subject to any disclaimer, the term of this patent is extended or adjusted under 35 U.S.C. 154(b) by 1210 days.

(21) Appl. No.: 11/274,913

(22) Filed: Nov. 14, 2005

(65) Prior Publication Data

US 2006/0103324 A1 May 18, 2006

(30) Foreign Application Priority Data

Nov. 15, 2004 (KR) ..... 10-2004-0093210

(51) Int. Cl.
*G09G 3/30* (2006.01)

(52) U.S. Cl.
USPC ..... 345/76; 345/77

(58) Field of Classification Search
USPC ..... 345/76–83; 315/169.3
See application file for complete search history.

(56) References Cited

U.S. PATENT DOCUMENTS

| | | | | |
|---|---|---|---|---|
| 6,859,193 | B1 * | 2/2005 | Yumoto | 345/82 |
| 7,193,588 | B2 * | 3/2007 | Lo | 345/76 |
| 2003/0062524 | A1 * | 4/2003 | Kimura | 257/72 |
| 2003/0090481 | A1 * | 5/2003 | Kimura | 345/211 |
| 2003/0107560 | A1 * | 6/2003 | Yumoto et al. | 345/204 |
| 2004/0070557 | A1 * | 4/2004 | Asano et al. | 345/76 |
| 2005/0083270 | A1 * | 4/2005 | Miyazawa | 345/76 |
| 2005/0093791 | A1 * | 5/2005 | Lo | 345/82 |
| 2005/0156838 | A1 | 7/2005 | Miyagawa et al. | |
| 2005/0200572 | A1 * | 9/2005 | Weng | 345/76 |

FOREIGN PATENT DOCUMENTS

| | | | |
|---|---|---|---|
| CN | 1407629 | | 4/2003 |
| CN | 1427385 | A | 7/2003 |
| CN | 1517965 | | 8/2004 |
| CN | 1534578 | A | 10/2004 |
| JP | 2004246204 | | 9/2004 |
| JP | 2005157244 | | 6/2005 |
| JP | 2005157308 | | 6/2005 |
| JP | 2005326828 | | 11/2005 |
| KR | 1020020027957 | A | 4/2002 |
| KR | 1020030081919 | A | 10/2003 |
| KR | 1020040009285 | A | 1/2004 |
| KR | 1020060042831 | A | 5/2006 |
| TW | I381340 | | 12/1993 |
| WO | 0106484 | A1 | 1/2001 |

* cited by examiner

*Primary Examiner* — Kevin M Nguyen
(74) *Attorney, Agent, or Firm* — Cantor Colburn LLP

(57) ABSTRACT

A display device has a plurality of pixels, where each pixel includes a light emitting element, a capacitor, a driving transistor having a control terminal, an input terminal, and an output terminal and supplying a driving current to the light emitting element to emit light, a first switching unit diode-connecting the driving transistor and supplying a data voltage to the capacitor in response to a scanning signal, and a second switching unit supplying a driving voltage to the driving transistor and connecting the capacitor to the driving transistor in response to the emission signal, wherein the capacitor is connected to the driving transistor through the first switching unit, stores a control voltage depending on the data voltage and the threshold voltage of the driving transistor, and is connected to the driving transistor through the second switching unit to supply the control voltage to the driving transistor.

25 Claims, 9 Drawing Sheets

DISPLAY DEVICE AND DRIVING METHOD THEREOF

This application claims priority to Korean Patent Application No. 10-2004-0093210, filed on Nov. 15, 2004 and all the benefits accruing therefrom under 35 U.S.C. §119, and the contents of which in its entirety are herein incorporated by reference.

BACKGROUND OF THE INVENTION (a) Field of the Invention

The present invention relates to a display device and a driving method thereof, and more particularly, the present invention relates to a light emitting display device and a driving method thereof.

(b) Description of the Related Art

Recent trends of lightweight and thin personal computers and television sets also require light-weight and thin display devices, and flat panel displays satisfying such a requirement are being substituted for conventional cathode ray tubes ("CRT").

Examples of flat panel displays include a liquid crystal display ("LCD"), field emission display ("FED"), organic light emitting diode ("OLED") display, plasma display panel ("PDP"), etc.

Generally, an active matrix flat panel display includes a plurality of pixels arranged in a matrix and the display displays images by controlling the luminance of the pixels based on given luminance information. An OLED display is a self-emissive display device that displays images by electrically exciting light emitting organic material, and the OLED display has low power consumption, wide viewing angle, and fast response time, thereby being advantageous for displaying motion images.

A pixel of an OLED display includes an OLED and a driving thin film transistor ("TFT"). The OLED emits light having an intensity depending on the current driven by the driving TFT, which in turn depends on the threshold voltage of the driving TFT and the voltage between gate and source of the driving TFT.

The TFT includes polysilicon or amorphous silicon a-Si. A polysilicon TFT has several advantages, however it also has disadvantages such as the complexity of manufacturing polysilicon, thereby increasing the manufacturing cost. In addition, it is hard to make a large OLED display employing polysilicon TFTs.

On the contrary, an a-Si TFT is easily applicable to a large OLED display and is manufactured by a lesser number of process steps than the polysilicon TFT. However, the threshold voltage of the a-Si TFT shifts as time passes under a long-time application of a DC control voltage such that the luminance is varied for a given data voltage.

Also, a long time driving of the OLED shifts the threshold voltage of the OLED. As for an OLED display employing an n-type driving TFT, since the OLED is connected to the source of the driving TFT, the shift of the threshold voltage of the OLED changes the voltage at the source of the driving TFT to vary the current driven by the driving TFT. Accordingly, the image quality of the OLED display may be degraded.

The shift of the threshold voltage of the driving transistor and the OLED may be compensated by providing several transistors between a driving voltage and the OLED. However, the several transistors may consume large power.

BRIEF SUMMARY OF THE INVENTION

The present invention solves the problems of conventional techniques.

In exemplary embodiments of the present invention, a display device including a plurality of pixels is provided. Each pixel includes a light emitting element, a capacitor, a driving transistor having a control terminal, an input terminal, and an output terminal and supplying a driving current to the light emitting element to emit light, a first switching unit diode-connecting the driving transistor and supplying a data voltage to the capacitor in response to a scanning signal, and a second switching unit supplying a driving voltage to the driving transistor and connecting the capacitor to the driving transistor in response to the emission signal, wherein the capacitor is connected to the driving transistor through the first switching unit, stores a control voltage depending on the data voltage and the threshold voltage of the driving transistor, and is connected to the driving transistor through the second switching unit to supply the control voltage to the driving transistor.

The first switching unit may include a first switching transistor connecting the control terminal and the input terminal of the driving transistor in response to the scanning signal, and a second switching transistor connecting the capacitor to the data voltage in response to the scanning signal.

The first switching unit may further include a third switching transistor supplying a common voltage to the output terminal of the driving transistor in response to the scanning signal.

The second switching unit may include a fourth switching transistor connecting the input terminal of the driving transistor to the driving voltage in response to the emission signal, and a fifth switching transistor connecting the capacitor and the output terminal of the driving transistor in response to the emission signal.

The control voltage may be equal to sum of the common voltage and the threshold voltage subtracted by the data voltage.

The data voltage may have a negative value.

The first to the fifth switching transistors and the driving transistor may include amorphous silicon thin film transistors and may include N type thin film transistors.

The light emitting element may include an organic light emitting member.

The driving voltage and the light emitting element may be connected by only the fourth switching transistor and the driving transistor during an emission period of the light emitting element.

A cut off period before an emission period of the light emitting element may ensure that the first switching transistor is turned off before the fourth switching transistor is turned on in the emission period.

The first through fifth switching transistors may be turned on during a precharging period, the fourth and fifth switching transistors may be turned off and the first through third switching transistors may remain on during a main charging period, the first through third switching transistors may be turned off and the fourth and fifth switching transistors may remain off during a cut off period, and the fourth and fifth switching transistors may be turned on and the first through third switching transistors may remain off during an emission period.

An output current of the light emitting element in an emission period of the light emitting element may not be dependent on the threshold voltage of the driving transistor. The output current of the light emitting element may be ½ k $(Vss-Vdata)^2$, where k is a constant, Vss is a common voltage, and Vdata is the data voltage.

The driving voltage and the light emitting element may be connected by no more than two transistors during an emission period of the light emitting element.

The display device may further include scanning lines providing the scanning signal, data lines providing the data voltage, and emission lines providing the emission signal, wherein the scanning lines and the emission lines are substantially parallel to each other, and the data lines are substantially perpendicular to the scanning lines and the emission lines.

In other exemplary embodiments of the present invention, a display device is provided, which includes a light emitting element, a driving transistor having a first terminal connected to a first voltage, a second terminal connected to the light emitting element, and a control terminal, a capacitor connected between the second terminal and the control terminal of the driving transistor, a first switching element operating in response to the scanning signal and connected between the first terminal and the control terminal of the driving transistor, a second switching element operating in response to the scanning signal and connected between the capacitor and a data voltage; a third switching element operating in response to the scanning signal and connected between the second terminal of the driving transistor and a second voltage, a fourth switching element operating in response to the emission signal and connected between the first voltage and the first terminal of the driving transistor, and a fifth switching element operating in response to the emission signal and connected between the capacitor and the second terminal of the driving transistor.

During first to fourth periods in series, the first to the fifth transistors turn on during the first period; the first, the second, and the fifth transistors turn on and the fourth and the fifth transistors turn off during the second period; the first to the fifth transistors turn off during the third period; and the first, the second, and the third transistors turn off and the fourth and the fifth transistors turn on during the fourth period.

The data voltage may be equal to or lower than about zero.

In still other exemplary embodiments of the present invention, a method of driving a display device including a light emitting element, a driving transistor having a control terminal, a first terminal, and a second terminal connected to the light emitting element, and a capacitor connected to the control terminal of the driving transistor is provided, which includes: connecting the control terminal and the first terminal of the driving transistor; connecting the second terminal of the driving transistor to a common voltage; connecting the capacitor to a data voltage; connecting the capacitor between the control terminal and the second terminal of the driving transistor; and connecting the first terminal of the driving transistor to a driving voltage.

The method may further include: applying a first voltage to the control terminal of the driving transistor to charge the capacitor.

The method may further include: isolating the control terminal and the first terminal of the driving transistor after the connection of the control terminal and the first terminal of the driving transistor.

The method may further include: separating the capacitor and the driving transistor from external signal sources.

In yet other exemplary embodiments of the present invention, a method of driving a display device including a light emitting element, a driving transistor connected to the light emitting element, and a capacitor connected to the driving transistor and the light emitting element is provided, which includes: applying a first voltage and a data voltage to be charged into the capacitor; discharging the voltage stored in the capacitor toward a second voltage through the driving transistor; applying the voltage of the capacitor after the discharge to the driving transistor to turn on the driving transistor; and supplying a driving current to the light emitting element through the driving transistor to emit light.

In yet other exemplary embodiments of the present invention a display device includes a light emitting element and a driving transistor supplying a driving current to the light emitting element, wherein a change in threshold voltage of the driving transistor does not substantially affect an output current of the light emitting element during an emission period.

The display device may further include a data line providing a data voltage, wherein the light emitting element is connected to a common voltage, and the output current of the light emitting element during the emission period is ½ k $(Vss-Vdata)^2$, where k is a constant, Vss is the common voltage, and Vdata is the data voltage.

A driving voltage and the light emitting element may be connected by no more than two transistors during the emission period, thus power consumption remains small.

BRIEF DESCRIPTION OF THE DRAWINGS

The present invention will become more apparent by describing embodiments thereof in detail with reference to the accompanying drawings in which.

DETAILED DESCRIPTION OF THE INVENTION

Figure 1:
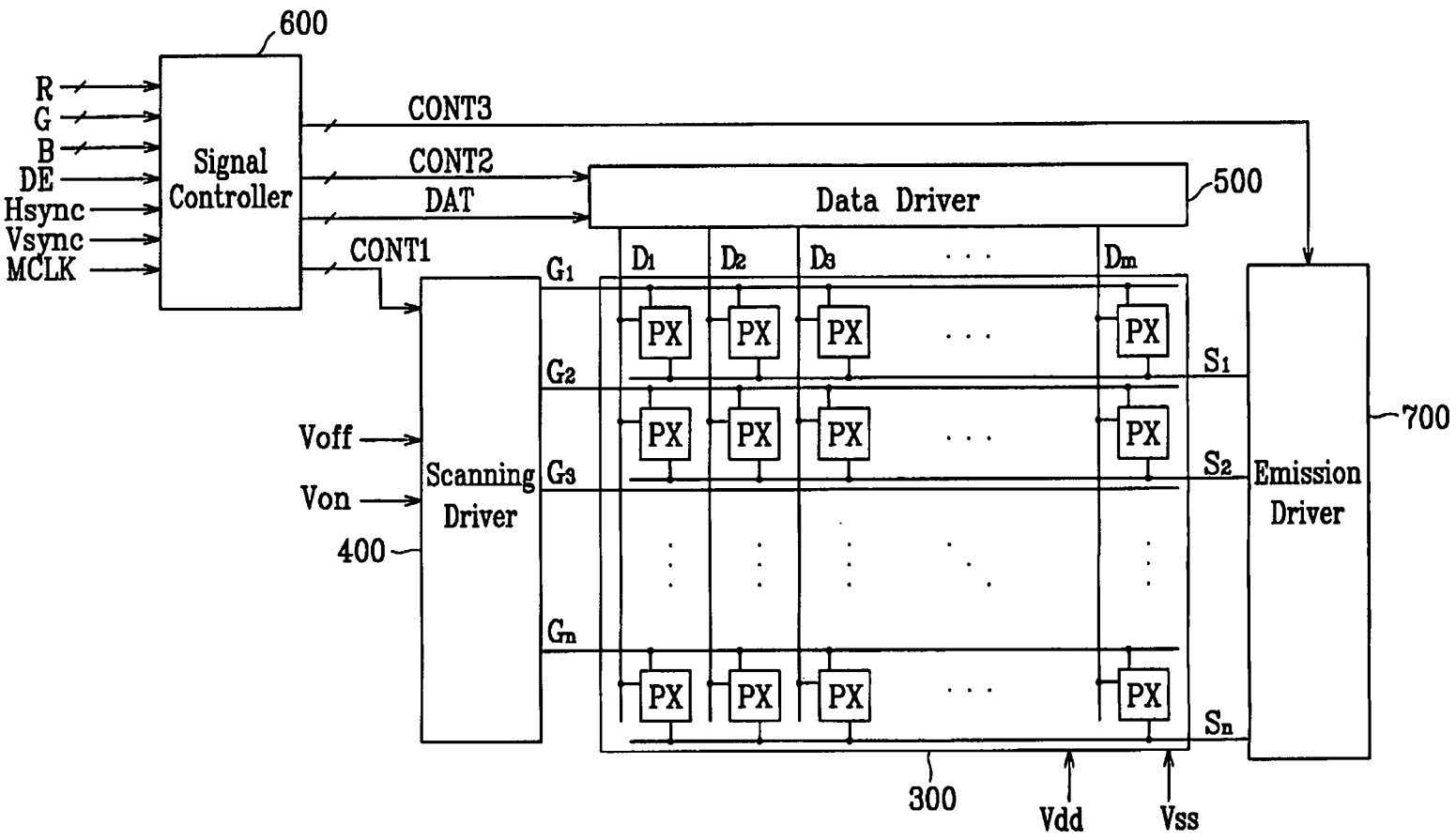
FIG. 1 is a block diagram of an exemplary embodiment of an OLED display according to the present invention.

The present invention will be described more fully hereinafter with reference to the accompanying drawings, in which preferred embodiments of the invention are shown.

In the drawings, the thickness of layers and regions are exaggerated for clarity. Like numerals refer to like elements throughout. It will be understood that when an element such as a layer, region, or substrate is referred to as being "on" another element, it can be directly on the other element or intervening elements may also be present. In contrast, when an element is referred to as being "directly on" another element, there are no intervening elements present.

Exemplary embodiments of display devices and driving methods thereof according to the present invention will now be described with reference to the accompanying drawings.

Referring to FIGS. 1-7, an exemplary embodiment of an organic light emitting diode ("OLED") display according to the present invention will be described in detail.

Figure 2:
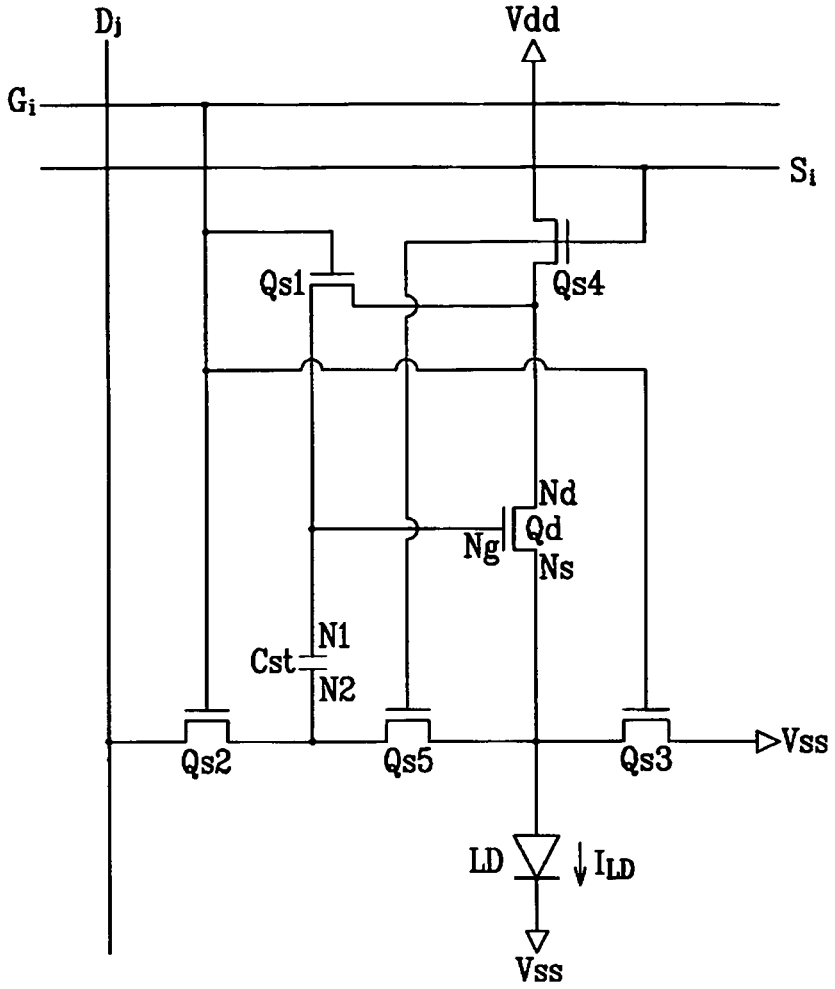
FIG. 2 is an equivalent circuit diagram of an exemplary pixel of an exemplary embodiment of an OLED display according to the present invention.

FIG. 1 is a block diagram of an exemplary embodiment of an OLED display according to the present invention and FIG. 2 is an equivalent circuit diagram of an exemplary pixel of an exemplary embodiment of an OLED display according to the present invention.

Referring to FIG. 1, an OLED display includes a display panel 300, three drivers including a scanning driver 400, a data driver 500, and an emission driver 700 that are each connected to the display panel 300, and a signal controller 600 controlling the above elements.

Referring to FIG. 1, the display panel 300 includes a plurality of signal lines, a plurality of voltage lines (not shown), and a plurality of pixels PX connected thereto and arranged substantially in a matrix.

The signal lines include a plurality of scanning lines $G_1$-$G_n$ (otherwise known as "gate lines") transmitting scanning signals (otherwise known as "gate signals"), a plurality of data lines $D_1$-$D_m$ transmitting data signals, and a plurality of emission lines $S_1$-$S_n$ transmitting emission signals. The scanning lines $G_1$-$G_n$ and the emission lines $S_1$-$S_n$ extend substantially in a row direction and substantially parallel to each other, while the data lines $D_1$-$D_m$ extend substantially in a column direction and substantially parallel to each other. The pixels PX are located between pairs of adjacent data lines $D_1$-$D_m$ and pairs of adjacent scanning lines $G_1$-$G_n$.

Referring to FIG. 2, the voltage lines include driving voltage lines (not shown) transmitting a driving voltage Vdd.

Each pixel PX, for example, a pixel connected to a scanning line $G_i$ and a data line $D_j$, includes an OLED LD, a driving transistor Qd, a capacitor Cst, and five switching transistors Qs1-Qs5. Each pixel PX is also connected to an emission line Si as shown.

The driving transistor Qd has a control terminal Ng, such as a gate terminal, an input terminal Nd, such as a drain terminal, and an output terminal Ns, such as a source terminal. The input terminal Nd of the driving transistor Qd is connected to the driving voltage Vdd.

The capacitor Cst is connected between the control terminal Ng and the output terminal Ns of the driving transistor Qd.

The OLED LD has an anode connected to the output terminal Ns of the driving transistor Qd and a cathode connected to a common voltage Vss. The OLED LD emits light having an intensity depending on an output current $I_{LD}$ of the driving transistor Qd. The output current $I_{LD}$ of the driving transistor Qd depends on the voltage Vgs between the control terminal Ng and the output terminal Ns.

The switching transistors Qs1-s3 operate in response to the scanning signals from the scanning lines G1-Gn. As will be further described, the switching transistors Qs1-s3 together form a first switching unit in the display device that diode connects the driving transistor Qd and supplies a data voltage tot the capacitor Cst in response to the scanning signals.

The switching transistor Qs1 is connected between the input terminal Nd and the control terminal Ng of the driving transistor Qd, the switching transistor Qs2 is connected between a data line $D_j$ and the capacitor Cst, and the switching transistor Qs3 is connected between the output terminal Ns of the driving transistor Qd and the common voltage Vss.

The switching transistors Qs4 and Qs5 operate in response to the emission signal from the emission lines S1-Sn. As will be further described, the switching transistors Qs4 and Qs5 together form a second switching unit in the display device that supplies a driving voltage Vdd to the driving transistor Qd and connects the capacitor Cst to the driving transistor Qd in response to the emission signals.

The switching transistor Qs4 is connected between the input terminal Nd of the driving transistor Qd and the driving voltage Vdd, and the switching transistor Qs5 is connected between the capacitor Cst and the output terminal Ns of the driving transistor Qd.

The switching transistors Qs1-Qs5 and the driving transistor Qd are n-channel field effect transistors ("FETs") including a-Si or polysilicon. However, the transistors Qs1-Qs5 and Qd may be p-channel FETs operating in a manner opposite to n-channel FETs.

Now, a structure of an OLED LD and a switching transistor Qs5 connected thereto as shown in FIG. 2 will be described in further detail with reference to FIGS. 3 and 4.

Figure 3:
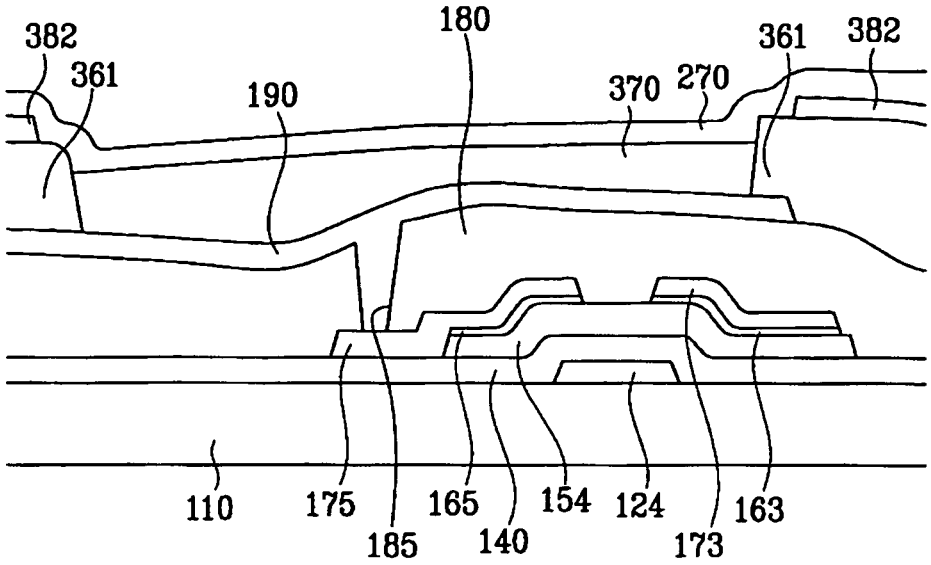
FIG. 3 is a sectional view of an exemplary light emitting element and an exemplary switching transistor shown in FIG. 2.
Figure 4:
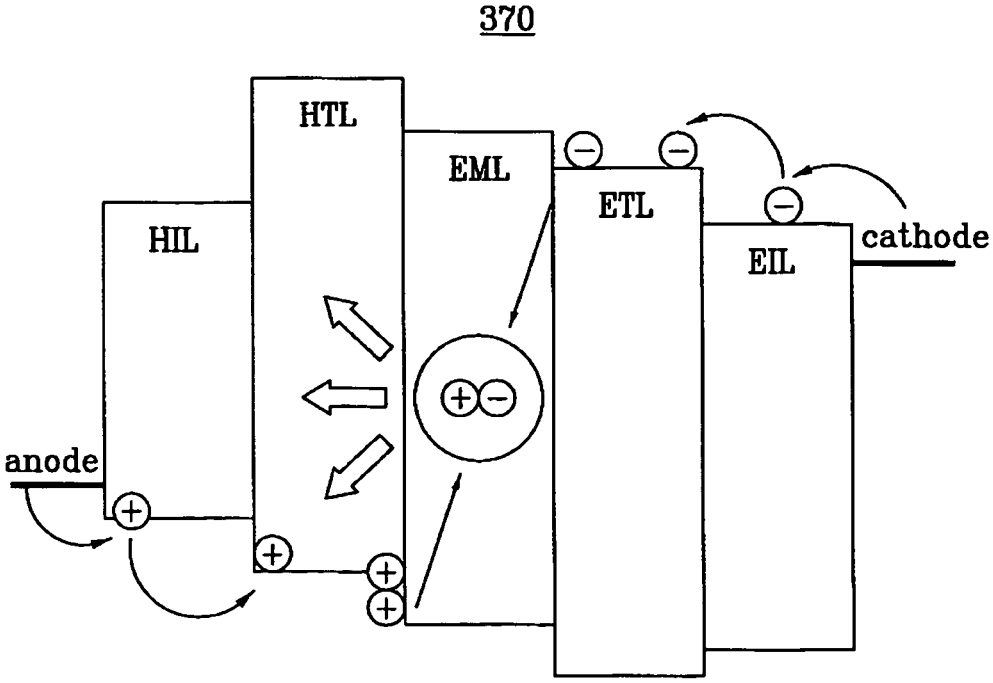
FIG. 4 is a schematic diagram of an exemplary embodiment of an organic light emitting element according to the present invention.

FIG. 3 is a sectional view of an exemplary OLED LD and an exemplary switching transistor Qs5 shown in FIG. 2, and FIG. 4 is a schematic diagram of an exemplary embodiment of an OLED according to the present invention.

A control electrode 124 is formed on an insulating substrate 110 and is otherwise known as a gate electrode. The control electrode 124 is preferably made of aluminum Al containing metal such as Al and Al alloy, silver Ag containing metal such as Ag and Ag alloy, copper Cu containing metal such as Cu and Cu alloy, molybdenum Mo containing metal such as Mo and Mo alloy, chromium Cr, titanium Ti, or tantalum Ta. The control electrode 124 may have a multi-layered structure including two films having different physical characteristics, in which case one of the two films is preferably made of a low resistivity metal including Al containing metal, Ag containing metal, and Cu containing metal for reducing signal delay or voltage drop. The other film in a multi-layered structure is preferably made of material such as Mo containing metal, Cr, Ta or Ti, which has good physical, chemical, and electrical contact characteristics with other materials such as indium tin oxide ("ITO") or indium zinc oxide ("IZO"). Examples of the combination of the two films that exhibit appropriate characteristics include a lower Cr film and an upper Al (alloy) film and a lower Al (alloy) film and an upper Mo (alloy) film. However, the gate electrode 124 may be made of various metals or conductors and are not limited to the examples described herein. The lateral sides of the gate electrode 124 are inclined relative to a surface of the insulating substrate 110, and the inclination angle thereof ranges about 30-80 degrees.

An insulating layer 140 preferably made of silicon nitride (SiNx) is formed on the control electrode 124, and may further be formed over portions of the insulating substrate 110 not covered by the control electrode 124.

A semiconductor 154 preferably made of hydrogenated a-Si or polysilicon is formed on the insulating layer 140, and a pair of ohmic contacts 163 and 165 preferably made of silicide or n+ hydrogenated a-Si heavily doped with n type impurity such as phosphorous are formed on the semiconductor 154. It should be understood that an impurity is a substance that is incorporated into a semiconductor material and provides free electrons (n type impurity) or holes (p type impurity). The process of doping is the introduction of dopant into a semiconductor for the purpose of altering its electrical properties, where the dopant is an element introduced into the semiconductor to establish either p-type (acceptors) or n-type (donors) conductivity. The lateral sides of the semiconductor 154 and the ohmic contacts 163 and 165 are inclined relative to the surface of the substrate 110, and the inclination angles thereof are preferably in a range of about 30-80 degrees.

An input electrode 173, e.g. a drain electrode, and an output electrode 175, e.g. a source electrode, are formed on the ohmic contacts 163 and 165 and the insulating layer 140. The input electrode 173 and the output electrode 175 are preferably made of refractory metal such as Cr, Mo, Ti, Ta or alloys thereof. However, they may have a multilayered structure including a refractory metal film (not shown) and a low resistivity film (not shown). Examples of the multi-layered structure that exhibit appropriate characteristics include a double-layered structure having a lower Cr/Mo (alloy) film and an upper Al (alloy) film and a triple-layered structure of a lower Mo (alloy) film, an intermediate Al (alloy) film, and an upper Mo (alloy) film. Like the control electrode 124, the input electrode 173 and the output electrode 175 have inclined edge profiles, and the inclination angles thereof with respect to the insulating substrate 110 range about 30-80 degrees.

The input electrode 173 and the output electrode 175 are separated from each other and disposed opposite each other with respect to the control electrode 124. The control electrode 124, the input electrode 173, and the output electrode 175 as well as the semiconductor 154 form a TFT serving as a switching transistor Qs5 having a channel located over the semiconductor 154 and between the input electrode 173 and the output electrode 175.

The ohmic contacts 163 and 165 are interposed only between the underlying semiconductor stripes of the semiconductor 154 and the overlying electrodes 173 and 175 thereon and reduce the contact resistance therebetween. The semiconductor 154 includes an exposed portion, which is not covered by the input electrode 173 and the output electrode 175.

A passivation layer 180 is formed on the electrodes 173 and 175, the exposed portion of the semiconductor 154, and the portions of the insulating layer 140 that are not covered by the electrodes 173 and 175 and the semiconductor 154. The passivation layer 180 is preferably made of an inorganic insulator such as silicon nitride or silicon oxide, an organic insulator, or a low dielectric insulating material. The low dielectric insulating material preferably has a dielectric constant lower than 4.0 and examples include a-Si:C:O and a-Si:O:F formed by plasma enhanced chemical vapor deposition ("PECVD"). The organic insulator may have photosensitivity, and the passivation layer 180 may have a flat surface. The passivation layer 180 may have a double-layered structure including a lower inorganic film and an upper organic film so that it may take advantage of the organic film as well as it protecting the exposed portions of the semiconductor 154. The passivation layer 180 has a contact hole 185 exposing a portion of the output electrode 175.

A pixel electrode 190 is formed on the passivation layer 180. The pixel electrode 190 is physically and electrically connected to the output electrode 175 through the contact hole 185 and it is preferably made of a transparent conductor such as ITO or IZO or reflective metal such as Cr, Ag, or Al.

A partition 361 is formed on the passivation layer 180 and may further cover portions of the pixel electrode 190. The partition 361 encloses the pixel electrode 190 to define an opening on the pixel electrode 190 like a bank, and it is preferably made of organic or inorganic insulating material.

An organic light emitting member 370 is formed on the pixel electrode 190 that is not overlapped by the partition 361. In other words, the organic light emitting member 370 is confined in the opening enclosed by the partition 361.

Referring to FIG. 4, the organic light emitting member 370 has a multilayered structure including an emitting layer EML and auxiliary layers for improving the efficiency of light emission of the emitting layer EML. The auxiliary layers include an electron transport layer ETL and a hole transport layer HTL for improving the balance of the electrons and holes. The emitting layer EML may be disposed between the electron transport layer ETL and the hole transport layer HTL. The auxiliary layers may further include an electron injecting layer EIL and a hole injecting layer HIL for improving the injection of the electrons and holes. The hole transport layer HTL may be positioned between the hole injecting layer HIL and the emitting layer EML. The electron transport layer ETL may be positioned between the emitting layer EML and the electron injecting layer EIL. Alternatively, the auxiliary layers may be omitted.

As further shown in FIG. 3, an auxiliary electrode 382 having low resistivity such as Al (alloy) is formed on the partition 361.

A common electrode 270 supplied with a common voltage Vss is formed on the organic light emitting member 370 and the partition 361, and may be further formed on the auxiliary electrode 382. The common electrode 270 is preferably made of a reflective metal such as Ca, Ba, Cr, Al or Ag, or a transparent conductive material such as ITO or IZO.

As the common electrode 270 is formed over the auxiliary electrode 382, the auxiliary electrode 382 contacts the common electrode 270 for compensating the conductivity of the common electrode 270 to prevent the distortion of the voltage of the common electrode 270.

A combination of opaque pixel electrodes 190 and a transparent common electrode 270 is employed in a top emission OLED display that emits light toward the top of the display panel 300, and a combination of transparent pixel electrodes 190 and an opaque common electrode 270 is employed in a bottom emission OLED display that emits light towards the bottom of the display panel 300.

A pixel electrode 190, an organic light emitting member 370, and a common electrode 270 form an OLED LD having the pixel electrode 190 as an anode and the common electrode 270 as a cathode or vice versa. The OLED LD uniquely emits one color of a set of color lights depending on the material of the light emitting member 370. An exemplary set of the colors includes red, green, and blue and the display of images is realized by the addition of the three colors. The set of colors may be primary colors and the display of images may be realized by the addition of the three primary colors.

Referring to FIG. 1 again, the scanning driver 400 is connected to the scanning lines $G_1$-$G_n$ of the display panel 300 and synthesizes a high level voltage Von for turning on the switching transistors Qs1-Qs3 (shown in FIG. 2) and a low level voltage Voff for turning off the switching transistors Qs1-Qs3 to generate scanning signals for application to the scanning lines $G_1$-$G_n$.

The data driver 500 is connected to the data lines $D_1$-$D_m$ of the display panel 300 and applies data signals Vdata to the data lines $D_1$-$D_m$.

The emission driver 700 is connected to the emission lines $S_1$-$S_n$ of the display panel 300 and synthesizes a high level voltage Von for turning on the switching transistors Qs4 and Qs5 and a low level voltage Voff for turning off the switching transistors Qs4 and Qs5 to generate emission signals for application to the emission lines $S_1$-$S_n$.

The signal controller 600 controls the scanning driver 400, the data driver 500, and the emission driver 700.

One or more of the scanning driver 400, the data driver 500, and the emission driver 700 may be implemented as an integrated circuit ("IC") chip mounted on the display panel 300 or on a flexible printed circuit ("FPC") film in a tape carrier package ("TCP") type, which are attached to the display panel 300. Alternately, the scanning driver 400, the data driver 500, and/or the emission driver 700 may be integrated into the display panel 300 along with the signal lines $G_1$-$G_n$, $D_1$-$D_m$, and $S_1$-$S_n$ and the transistors Qd and Qs1-Qs5.

Now, the operation of the above-described OLED display will be described in detail with reference to FIGS. 1-2 and with additional reference to FIGS. 5-7.

Figure 5:
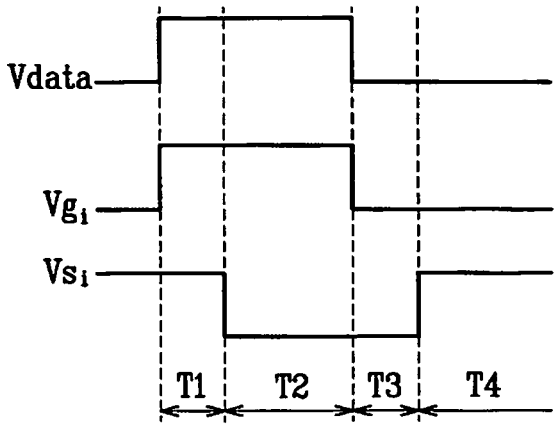
FIG. 5 is a timing chart illustrating several exemplary signals for an exemplary embodiment of an OLED display according to the present invention.
Figure 6A:
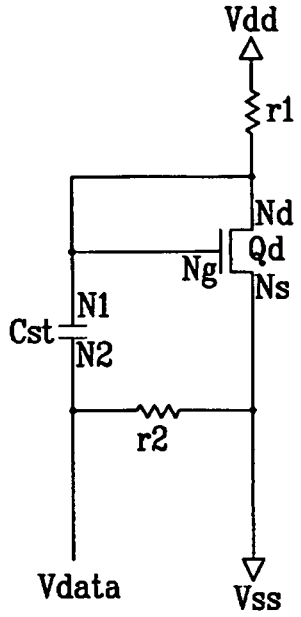
FIGS. 6A-6D are equivalent circuit diagrams of an exemplary pixel for respective periods shown in FIG. 5.
Figure 6B:
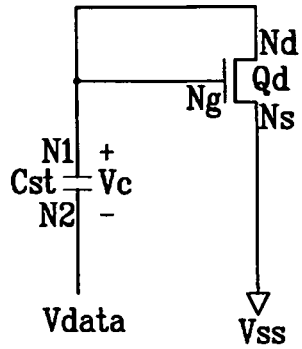
Figure 6C:
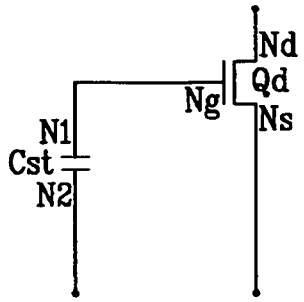
Figure 6D:
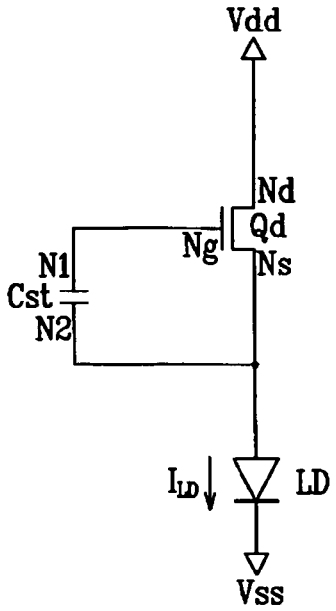
Figure 7:
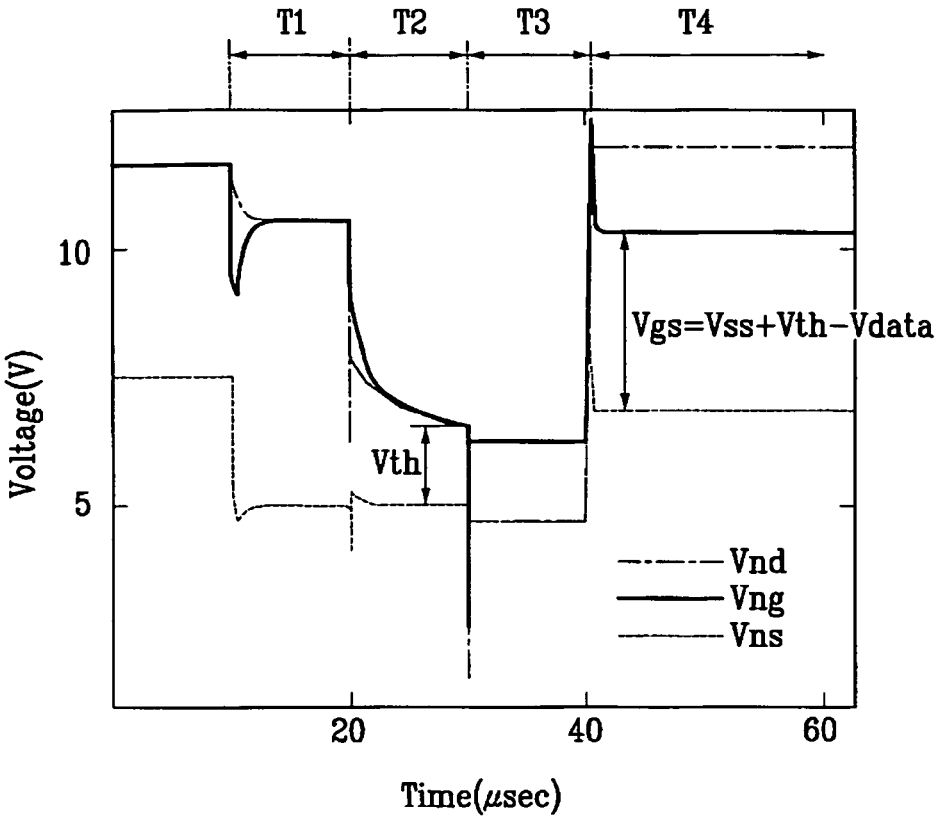
FIG. 7 illustrates waveforms of the voltages at the terminals of the exemplary driving transistor of an exemplary embodiment of an OLED display according to the present invention.

FIG. 5 is a timing chart illustrating several signals for an exemplary embodiment of an OLED display according to the present invention, FIGS. 6A-6D are equivalent circuit diagrams of an exemplary pixel for respective periods shown in FIG. 5, and FIG. 7 illustrates waveforms of the voltages at the terminals of the exemplary driving transistor of an exemplary embodiment of an OLED display according to the present invention.

As shown in FIG. 1, the signal controller 600 is supplied with input image signals R, G, and B and input control signals controlling the display panel 300. The input control signals include, for example, a vertical synchronization signal Vsync, a horizontal synchronization signal Hsync, a main clock MCLK, and a data enable signal DE, from an external graphics controller (not shown). After generating scanning control signals CONT1, data control signals CONT2, and emission control signals CONT3 and processing the image signals R, G and B suitable for the operation of the display panel 300 on the basis of the input control signals and the input image signals R, G and B, the signal controller 600 sends the scanning control signals CONT1 to the scanning driver 400, the processed image signals DAT and the data control signals CONT2 to the data driver 500, and the emission control signals CONT3 to the emission driver 700.

The scanning control signals CONT1 include a scanning start signal STV for instructing the start of scanning and at least one clock signal for controlling the output time of the high level voltage Von. The scanning control signals CONT1 may include a plurality of output enable signals OE for defining the duration of the high level voltage Von.

The data control signals CONT2 include a horizontal synchronization start signal STH for informing the start of data transmission for a group of pixels PX, a load signal LOAD for instructing the application of the data voltages to the data lines $D_1$-$D_m$, and a data clock signal HCLK.

Responsive to the data control signals CONT2 from the signal controller 600, the data driver 500 receives a packet of the image data for a group of pixels PX, for example, the i-th pixel row from the signal controller 600, converts the image data into analog data voltages Vdata, and applies the data voltages Vdata to the data lines $D_1$-$D_m$.

The scanning driver 400 makes a scanning signal $Vg_i$ for the i-th scanning signal line $G_i$ equal to the high level voltage Von in response to the scanning control signals CONT1 from the signal controller 600, thereby turning on the switching transistors Qs1-Qs3 connected to the i-th scanning signal line $G_i$. At this time, the driving transistor Qd is diode-connected, where the control terminal Ng and the input terminal Nd of the driving transistor Qd are connected to each other.

The emission driver 700 keeps the emission signal $V_{si}$ to be equal to the high level voltage Von in response to the emission control signals CONT3 from the signal controller 600, thereby maintaining the switching transistors Qs4 and Qs5 to be turned on.

FIG. 6A shows an equivalent circuit of a pixel in this state, and this period is referred to as a precharging period T1 as shown in FIG. 5. The switching transistors Qs4 and Qs5 can be represented as resistors r1 and r2, respectively, as shown in FIG. 6A.

Since a terminal N1 of the capacitor Cst and the control terminal Ng of the driving transistor Qd are connected to the driving voltage Vdd through the resistor r1, their voltages are equal to the driving voltage Vdd subtracted by a voltage drop of the resistor r1 and maintained by the capacitor Cst. At this time, it is preferable that the driving voltage Vdd is higher than the data voltage Vdata to turn on the driving transistor Qd.

Then, the driving transistor Qd turns on to output a current and the current driven by the driving transistor Qd flows into the common voltage Vss rather than into the OLED LD. Accordingly, the OLED LD does not emit light in the precharging period T1 so that the image quality is improved.

Next, a main charging period T2, shown in FIG. 5, starts when the emission driver 700 changes the emission signal $V_{si}$ into the low level voltage Voff to turn off the switching transistors Qs4 and Qs5, previously represented in FIG. 6A as r1 and r2. Since the scanning signal $V_{gi}$ maintains the high level voltage Von in this period T2, the switching transistors Qs1-Qs3 keep their conduction state.

Referring to FIG. 6B, the driving transistor Qd is separated from the driving voltage Vdd while maintaining a diode connection, where the control terminal Ng and the input terminal Nd of the driving transistor Qd are connected to each other, and the output terminal Ns of the driving transistor Qd is still supplied with the common voltage Vss. Since the control terminal voltage Vng of the driving transistor Qd is sufficiently high, the driving transistor Qd maintains its conduction state.

Therefore, the capacitor Cst begins to discharge its voltage precharged in the precharging period T1 through the driving transistor Qd and the control terminal voltage Vng of the driving transistor Qd becomes lower as shown in FIG. 7. The voltage drop of the control terminal voltage Vng continues until the voltage Vgs between the control terminal Ng and the output terminal Ns of the driving transistor Qd is equal to the threshold voltage Vth of the driving transistor Qd, where the voltage Vgs is equal to the voltage Vng of the control terminal subtracted by the voltage Vns of the output terminal to be equal to the threshold voltage Vth, such that the driving transistor Qd supplies no more current.

That is, during the main charging period T2, $$Vgs=Vth \tag{1}$$

In the meantime, one terminal N2 of the capacitor Cst is still supplied with a data voltage Vdata, and a voltage stored in the capacitor Cst is equal to the difference between the control terminal voltage Vng of the driving transistor Qd and the data voltage Vdata.

Then, the voltage Vc stored in the capacitor Cst is given by:

$$Vc=Vss+Vth-V\text{data}. \tag{2}$$

Accordingly, the voltage stored in the capacitor Cst depends only on the data voltage Vdata and the threshold voltage Vth of the driving transistor Qd, as the common voltage Vss may be zero.

Since the voltage Vc determines the current $I_{LD}$ of the OLED in the emission period T4, the data voltage Vdata inputted is equal to or less than zero.

After the voltage Vc is stored in the capacitor Cst, the scanning driver 400 changes the scanning signal $V_{gi}$ into the low level voltage Voff to turn off the switching transistors Qs1-Qs3, which is referred to as a cut off period T3. Since the emission signal $V_{si}$ keeps the low level voltage Voff in this period T3, the switching transistors Qs4 and Qs5 maintain their off states.

Referring to FIG. 6C, the input terminal Nd of the driving transistor Qd and the terminal N2 of the capacitor Cst are opened. Although the output terminal Ns of the driving transistor Qd is coupled to the OLED LD, the driving transistor Qd does not drive a current and thus it is equivalent to a case where the output terminal Ns of the driving transistor Qd is opened. Accordingly, there is not inflow and outflow of charges for the circuit and the capacitor Cst maintains its voltage Vc stored in the main charging period T2.

After a predetermined time elapses from the turn off of all the switching transistors Qs1 and Qs5, the emission driver 700 changes the emission signal $V_{si}$ into the high level voltage Von to turn on the switching transistors Qs4 and Qs5 such that an emission period T4 starts. Since the scanning signal $V_{gi}$ maintains its low level voltage Voff in this period T4, the switching transistors Qs1-Qs3 are still in off states.

Referring to FIG. 6D, the capacitor Cst is connected between the control terminal Ng and the output terminal Ns of the driving transistor Qd, the input terminal Nd of the driving transistor Qd is connected to the driving voltage Vdd, and the output terminal Ns of the driving transistor Qd is connected to the OLED LD.

Referring to FIG. 7, since the terminal N1 of the capacitor Cst is opened, the voltage Vgs between the control terminal voltage Vng and the output terminal voltage Vns of the driving transistor Qd becomes equal to the voltage Vc stored in the capacitor Cst (i.e., Vgs=Vc), the driving transistor Qd supplies the output current $I_{LD}$ to the OLED LD, which has a magnitude controlled by the voltage Vgs. Accordingly, the OLED LD emits light having an intensity depending on the magnitude of the output current $I_{LD}$, thereby displaying an image.

Since the capacitor Cst maintains the voltage Vc stored in the main charging period T2 (i.e., Vc=Vss+Vth−Vdata) regardless of the load exerted by the OLED LD, the output current $I_{LD}$ is expressed as follows:

$$\begin{aligned} I_{LD} &= \frac{1}{2}k(Vgs - Vth)^2 \\ &= \frac{1}{2}k(Vss + Vth - Vdata - Vth)^2 \\ &= \frac{1}{2}k(Vss - Vdata)^2. \end{aligned} \tag{3}$$

Here, k is a constant depending on the characteristic of the transistor and given by an equation k=μ·Ci·W/L, where μ denotes field effect mobility, Ci denotes a capacitance of an insulator disposed between a control terminal and a channel, W denotes the channel width, and L denotes the channel length.

Referring to Relation 3, the output current $I_{LD}$ in the emission period T4 is determined only by the data voltage Vdata and the common voltage Vss, since k is a constant. Therefore, the output current $I_{LD}$ is affected neither by the change of the threshold voltage Vth of the driving transistor Qd nor by the change the threshold voltage $Vth_{LD}$ of the OLED LD.

As a result, the exemplary embodiment of the OLED display according to the present invention compensates for the change of the threshold voltage Vth of the driving transistor Qd and the threshold voltage $Vth_{LD}$ of the OLED LD.

In addition, since only the switching transistor Qs4 and the driving transistor Qd are connected between the driving voltage Vdd and the OLED LD in the emission period T4, the power consumption is small.

If the emission period T4 had started immediately after the main charging period T2 finished, the switching transistor Qs4 may turn on before the switching transistor Qs1 turns off such that the charge carriers from the driving voltage Vdd enter into the capacitor Cst, thereby changing the voltage Vc stored in the capacitor Cst. Instead, in the exemplary embodiment of the present invention, the cut off period T3 is disposed between the main charging period T2 and the emission period T4 and ensures that the switching transistor Qs4 turns on after the switching transistor Qs1 is turned off.

The emission period T4 continues until the precharging period T1 for the corresponding pixels starts again in the next frame. The operation of the OLED display in the periods T1-T4 repeats for the next group of pixels. However, it is noted that the precharging period T1 for the (i+1)-th pixel row, for example, starts after the main charging period T2 for the i-th pixel row finishes. In this way, the operations in the periods T1-T4 are performed for all the pixels to display images.

The length of the periods T1-T4 may be adjusted.

The common voltage Vss may be equal to about 0V. The driving voltage Vdd preferably has a magnitude, for example, equal to 15V sufficient for supplying charge carriers to the capacitor Cst and for making the driving transistor Qd generate the output current $I_{LD}$. The data voltage Vdata has a negative sign as described above, and the output current $I_{LD}$ increases as the absolute magnitude of the data voltage Vdata increases.

Simulations were performed for a change of the threshold voltages, which will be described in detail with reference to FIGS. 8 and 9.

Figure 8:
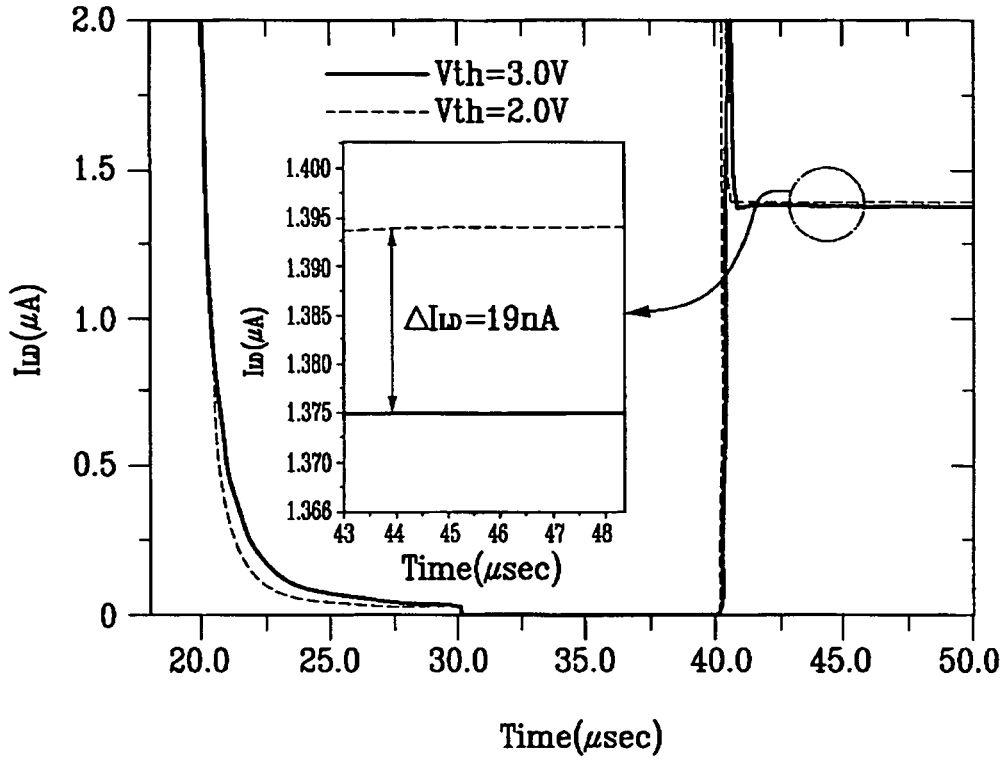
FIG. 8 illustrates waveforms of the output current for different threshold voltages of the exemplary driving transistor.
Figure 9:
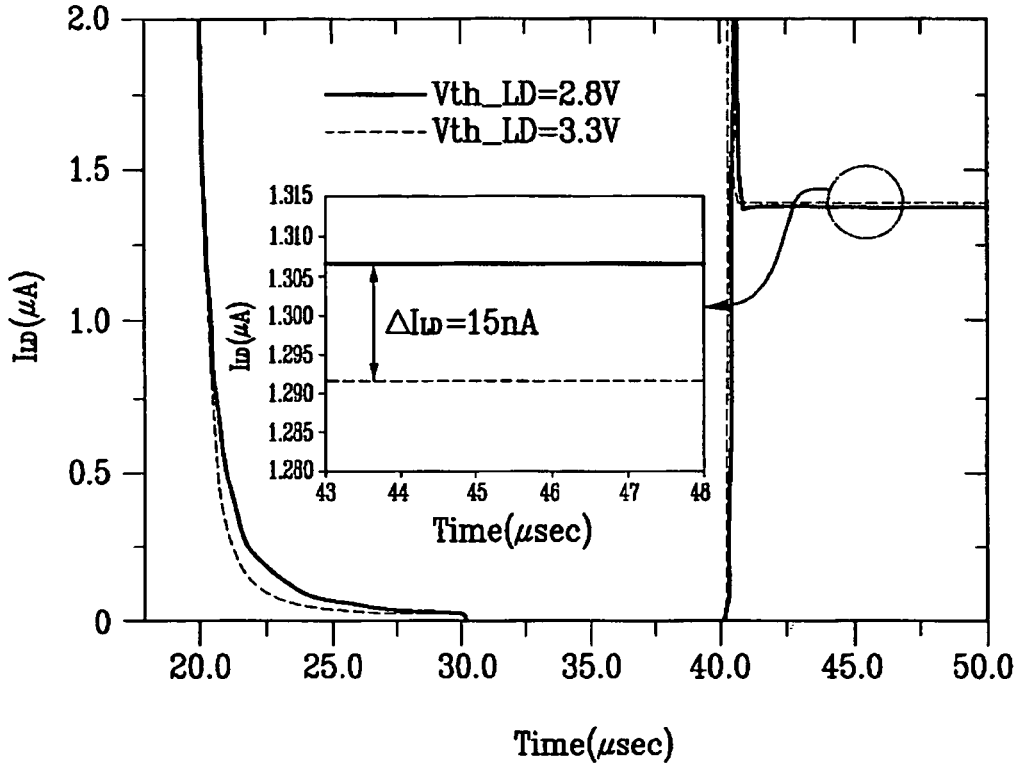
FIG. 9 illustrates waveforms of the output current for different threshold voltages of the exemplary light emitting element.

FIG. 8 illustrates waveforms of the output current for different threshold voltages of the exemplary driving transistor, and FIG. 9 illustrates waveforms of the output current for different threshold voltages of the exemplary OLED.

The simulations were performed by using SPICE (Simulation Program with Integrated Circuit Emphasis). The simulations were performed under the condition that the driving voltage Vdd is equal to 15V, the common voltage Vss is equal to 0V, and the data voltage Vdata is equal to −4.5V. It should be understood that the OLED display of these embodiments may also run under varying conditions, and that these conditions are exemplary only.

FIG. 8 shows the variation of the output current $I_{LD}$ when the threshold voltage Vth of the driving transistor Qd changes from 2.0V to 3.0V. The current of the OLED LD, i.e., the output current $I_{LD}$ was equal to about 1.394 μA for the threshold voltage Vth of 2.0V and equal to about 1.375 μA for the threshold voltage Vth of 3.0V. Accordingly, when the threshold voltage Vth of the driving transistor Qd is increased by 1V, the variation of the current was only about 19 nA, which is only 1.363% with respect to the initial current.

FIG. 9 shows the variation of the output current $I_{LD}$ when the threshold voltage $Vth_{LD}$ of the OLED LD changes from 2.8V to 3.3V. The output current $I_{LD}$ was equal to about 1.306 μA for the threshold voltage $Vth_{LD}$ of 2.8V and equal to about 1.291 μA for the threshold voltage $Vth_{LD}$ of 3.3V. Accordingly, when the threshold voltage $Vth_{LD}$ of the OLED LD is increased by 0.5V, the variation of the current was only about 15 nA, which is only 1.149% with respect to the initial current.

These variations of the output current $I_{LD}$ are negligible compared with a conventional OLED display including two driving transistors per one pixel.

The simulations show that the OLED display according to the embodiment of the present invention compensates for the change of the threshold voltage Vth of the driving transistor Qd and the threshold voltage $Vth_{LD}$ of the OLED LD.

As described above, exemplary embodiments of the OLED display according to the present invention includes five switching transistors, one driving transistor, an OLED, and a capacitor. The capacitor stores a voltage depending on a data voltage and a threshold voltage of a driving transistor to compensate the shift of the threshold voltage of the driving transistor and the OLED, thereby preventing the degradation of the image quality.

In addition, the current flow except for in the emission period through the OLED is blocked to improve the image quality, and only two transistors are connected between the driving voltage and the OLED in the emission period to reduce the power consumption.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A display device comprising a plurality of pixels, each pixel including:

a light emitting element;

a capacitor;

a driving transistor having a control terminal, an input terminal, and an output terminal which is connected to the light emitting element, the driving transistor for supplying a driving current to the light emitting element to emit light;

a first switching unit comprising a first switching transistor for electrically connecting the control terminal and the input terminal of the driving transistor in response to a scanning signal; and a second switching unit supplying a driving voltage to the driving transistor and connecting the capacitor to the driving transistor both in response to an emission signal, wherein the capacitor is connected to the driving transistor through the first switching unit, stores a control voltage depending on the common voltage, the data voltage and a threshold voltage of the driving transistor, and is connected to the driving transistor through the second switching unit to supply the control voltage to the driving transistor.

2. The display device of claim 1, wherein the first switching unit further comprises:

a second switching transistor connecting the capacitor to the data voltage in response to the scanning signal.

3. The display device of claim 2, wherein the first switching unit further comprises a third switching transistor for supplying a common voltage to the output terminal of the driving transistor in response to the scanning signal.

4. The display device of claim 3, wherein the second switching unit comprises:

a fourth switching transistor connecting the input terminal of the driving transistor to the driving voltage in response to the emission signal; and a fifth switching transistor connecting the capacitor and the output terminal of the driving transistor in response to the emission signal.

5. The display device of claim 4, wherein the control voltage is equal to sum of the common voltage and the threshold voltage subtracted by the data voltage.

6. The display device of claim 4, wherein the data voltage has a negative value.

7. The display device of claim 4, wherein the first to the fifth switching transistors and the driving transistor comprise amorphous silicon thin film transistors.

8. The display device of claim 4, wherein the first to the fifth switching transistors and the driving transistor comprise N type thin film transistors.

9. The display device of claim 4, wherein the light emitting element comprises an organic light emitting member.

10. The display device of claim 4, wherein the driving voltage and the light emitting element are connected by only the fourth switching transistor and the driving transistor during an emission period of the light emitting element.

11. The display device of claim 4, wherein a cut off period before an emission period of the light emitting element ensures that the first switching transistor is turned off before the fourth switching transistor is turned on in the emission period.

12. The display device of claim 4, wherein the first through fifth switching transistors are turned on during a precharging period, the fourth and fifth switching transistors are turned off and the first through third switching transistors remain on during a main charging period, the first through third switching transistors are turned off and the fourth and fifth switching transistors remain off during a cut off period, and the fourth and fifth switching transistors are turned on and the first through third switching transistors remain off during an emission period.

13. The display device of claim 4, wherein an output terminal of the fourth switching transistor is connected to both an input terminal of the first switching transistor and the input terminal of the driving transistor.

14. The display device of claim 4, wherein an output terminal of the third switching transistor is connected to both an output terminal of the fifth switching transistor and the output terminal of the driving transistor.

15. The display device of claim 1, wherein an output current of the light emitting element in an emission period of the light emitting element is not dependent on the threshold voltage of the driving transistor.

16. The display device of claim 15, wherein the output current of the light emitting element is $\frac{1}{2}$ k $(Vss-Vdata)^2$, where k is a constant, Vss is the common voltage, and Vdata is the data voltage.

17. The display device of claim 1, wherein the driving voltage and the light emitting element are connected by no more than two transistors during an emission period of the light emitting element.

18. The display device of claim 1, further comprising scanning lines providing the scanning signal, data lines providing the data voltage, and emission lines providing the emission signal, wherein the scanning lines and the emission lines are substantially parallel to each other, and the data lines are substantially perpendicular to the scanning lines and the emission lines.

19. A display device comprising:

a light emitting element;

a driving transistor having a first terminal connected to a driving voltage, a second terminal connected to the light emitting element, and a control terminal;

a capacitor connected to the control terminal of the driving transistor and stores a control voltage depending on a common voltage, a data voltage and a threshold voltage of the driving transistor;

a first switching element connected between the first terminal and the control terminal of the driving transistor for electrically connecting the control terminal and the first terminal of the driving transistor in response to a scanning signal;

a second switching element operating in response to the scanning signal and connected between the capacitor and the data voltage;

a third switching element operating in response to the scanning signal and connected between the second terminal of the driving transistor and the common voltage;

a fourth switching element operating in response to an emission signal and connected between the driving voltage and the first terminal of the driving transistor; and a fifth switching element operating in response to the emission signal and connected between the capacitor and the second terminal of the driving transistor.

20. The display device of claim 19, wherein during first to fourth periods in series, the first to the fifth transistors turn on during the first period;

the first, the second, and the third transistors turn on and the fourth and the fifth transistors turn off during the second period;

the first to the fifth transistors turn off during the third period; and the first, the second, and the third transistors turn off and the fourth and the fifth transistors turn on during the fourth period.

21. The display device of claim 20, wherein the data voltage is equal to or lower than about zero.

22. A method of driving a display device including a light emitting element, a driving transistor having a control terminal, a first terminal, and a second terminal connected to the light emitting element, and a capacitor connected to the control terminal of the driving transistor, the method comprising:

connecting the control terminal and the first terminal of the driving transistor;

connecting the second terminal of the driving transistor to a common voltage;

connecting the capacitor to a data voltage;

connecting the capacitor between the control terminal and the second terminal of the driving transistor;

connecting the first terminal of the driving transistor to a driving voltage; and applying a first voltage depending on the common voltage, the data voltage and a threshold voltage of the driving transistor to the capacitor.

23. The method of claim 22, further comprising:

isolating the control terminal and the first terminal of the driving transistor after connecting the control terminal and the first terminal of the driving transistor.

24. The method of claim 23, further comprising:

separating the capacitor and the driving transistor from external signal sources.

25. A display device comprising:

a light emitting element;

a driving transistor supplying a driving current to the light emitting element; and a data line providing a data voltage, wherein a cathode of the light emitting element and an output terminal of the driving transistor are connected to a common voltage during a charging period, the light emitting does not emit light during the charging period, and the output current of the light emitting element during an emission period after the charging period is $\frac{1}{2} k (Vss - Vdata)^2$, where k is a constant, Vss is the common voltage, and Vdata is the data voltage, wherein a change in threshold voltage of the driving transistor does not substantially affect an output current of the light emitting element during an emission period.

* * * * *